US005820179A

United States Patent [19]

Tsou

[11] Patent Number: 5,820,179

[45] Date of Patent: Oct. 13, 1998

[54] REFUSE COLLECTION DEVICE

[76] Inventor: Eric Tsou, 7F, No. 56, Lane 103, Sec. 2, Nei Hu Road, Taipei, Taiwan

[21] Appl. No.: 986,679

[22] Filed: Dec. 8, 1997

[51] Int. Cl.[6] ..... A01K 29/00; E01H 1/12

[52] U.S. Cl. ..... 294/1.4; 15/257.6

[58] Field of Search ..... 294/1.3–1.5, 19.1, 294/22, 24, 50.8, 50.9, 55, 115; 15/104.8, 257.1, 257.4, 257.6, 257.7; 119/161, 165

[56] References Cited

U.S. PATENT DOCUMENTS

| | | | |
|---|---|---|---|
| 5,320,393 | 6/1994 | Cortinas | 294/1.4 |
| 5,540,470 | 7/1996 | Lu | 294/1.4 |
| 5,671,959 | 9/1997 | Tsou | 294/1.4 |

*Primary Examiner*—Johnny D. Cherry
*Attorney, Agent, or Firm*—Ostrolenk, Faber, Gerb & Soffen, LLP

[57] ABSTRACT

A refuse collection device includes an elongated tubular assembly comprising an inner tube, an intermediate tube and an outer tube telescoping each other and a bag mount supporting thereon a refuse collection bag attached to the lower end of the tubular assembly and closable by means of a pivoting cover. A manual controller is provided, including a first grip fixed to the outer tube and a second grip fixed to the intermediate tube so as to allow the first grip and the outer tube to be movable relative to the second grip and the intermediate tube between an upper open position and a lower closed position. The cover is coupled to the outer tube so as to be driven thereby between the open position and the closed position. Spherical members are received within openings formed on the intermediate tube and spring-biased to selectively engage a recess formed on the outer tube so as to secure the outer tube in the open position. The inner tube is also movable and spring-biased relative to the intermediate tube to expand and thus securely hold the collection bag. A releasing mechanism is provided to move the inner tube relative to the intermediate tube for releasing the bag against the biasing spring. The releasing mechanism also functions to release the outer tube from the open position.

10 Claims, 7 Drawing Sheets

REFUSE COLLECTION DEVICE

FIELD OF THE INVENTION

The present invention relates to a refuse collection device for collecting refuse in a more sanitary manner.

BACKGROUND OF THE INVENTION

Collecting refuse, especially animal dropping, is always a disgusting job. To collect the refuse without using hand to directly pick up the refuse, there are a variety of refuse collection devices proposed and available in the market. One example of such refuse collection devices is Taiwan patent application No. 84206639 and an additional application associated therewith filed by the applicant. (A corresponding U.S. patent application Ser. No. 08/733,958 which is now granted as U.S. Pat. No. 5,671,959 is also filed by the applicant.) Such a prior art device although working well, yet has a disadvantage in that the prior art refuse collection device is controlled mainly by means of a flexible rope or wire which extends from the scooping cover of the device through a plurality of holes formed on an elongated rod to which the cover is attached and the parts associated therewith to a manual control. This significantly increases the manufacture cost due to its complication in structure. Also, in such a prior art device, inconvenience in operation may be sometime encountered.

Thus, it is desirable to provide an improvement over such a conventional refuse collection device which is cheap in manufacture cost and easier to operate.

SUMMARY OF THE INVENTION

Therefore, the principal object of the present invention is to provide a refuse collection device which is easier to manufacture and operate so as to reduce the manufacture cost and to facilitate the operation thereof by the general consumers.

In accordance with the present invention, to achieve the above object, there is provided a refuse collection device comprising an elongated tubular assembly comprising an inner tube, an intermediate tube and an outer tube telescoping each other and a bag mount supporting thereon a refuse collection bag attached to the lower end of the tubular assembly and closable by means of a pivoting cover. A manual controller is provided, comprising a first grip fixed to the outer tube and a second grip fixed to the intermediate tube so as to allow the first grip and the outer tube to be movable relative to the second grip and the intermediate tube between an upper open position and a lower closed position. The cover is coupled to the outer tube so as to be driven thereby between the open position and the closed position. Spherical members are received within openings formed on the intermediate tube and spring-biased to selectively engage corresponding recesses formed on the outer tube so as to secure the outer tube in the open position. The inner tube is also movable and spring-biased relative to the intermediate tube to expand and thus securely hold the collection bag. A releasing mechanism is provided to move the inner tube relative to the intermediate tube for releasing the bag against the biasing spring. The releasing mechanism also functions to release the outer tube from the open position.

BRIEF DESCRIPTION OF THE DRAWINGS

The present invention will be better understood from the following description of a preferred embodiment in accordance with the present invention, with reference to the attached drawings, wherein.

DETAILED DESCRIPTION OF THE PREFERRED EMBODIMENT

Figure 1:
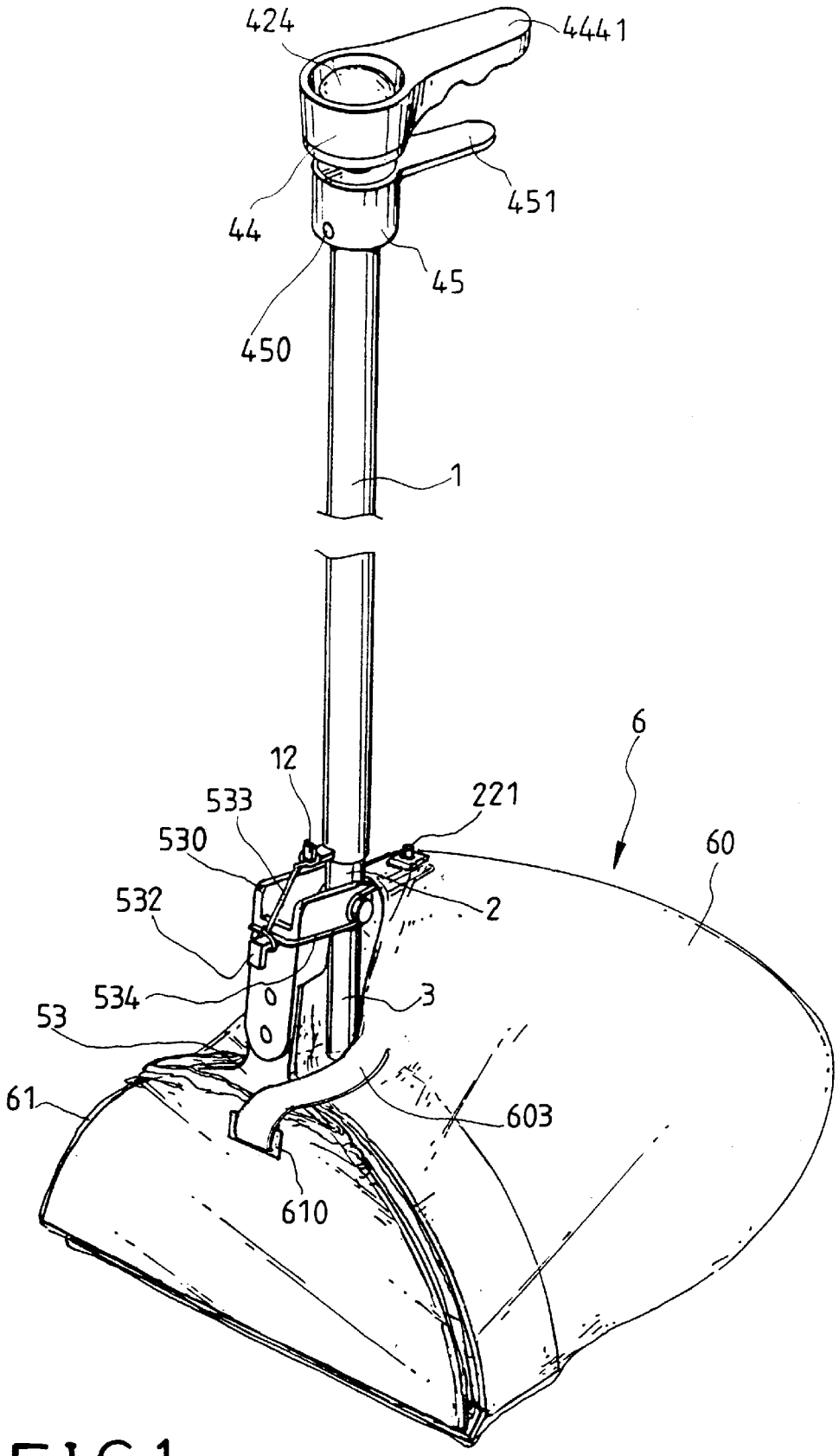
FIG. 1 is a perspective view showing a refuse collection device constructed in accordance with the present invention.
Figure 2:
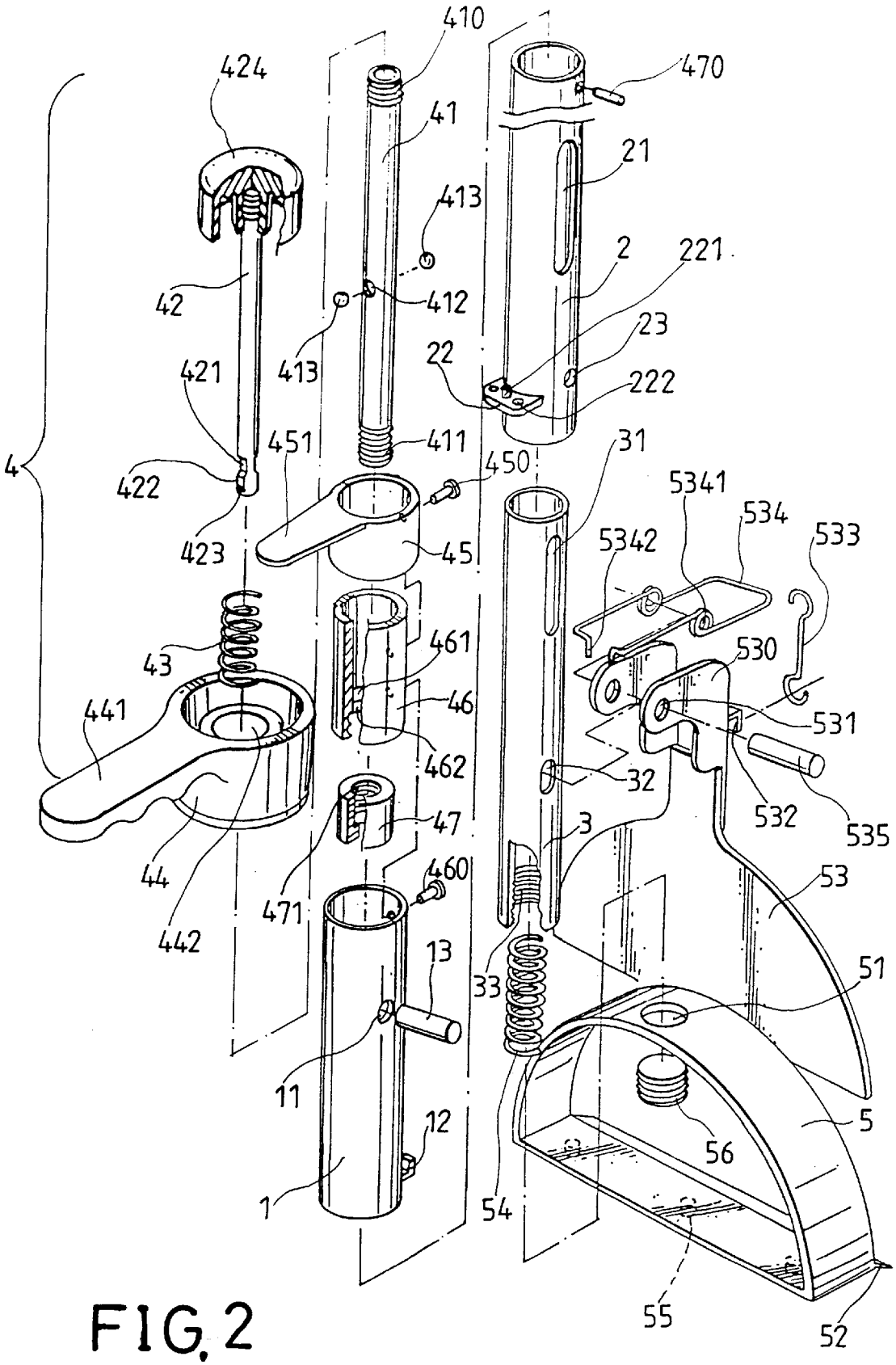
FIG. 2 is an exploded perspective view of the refuse collection device.
Figure 3:
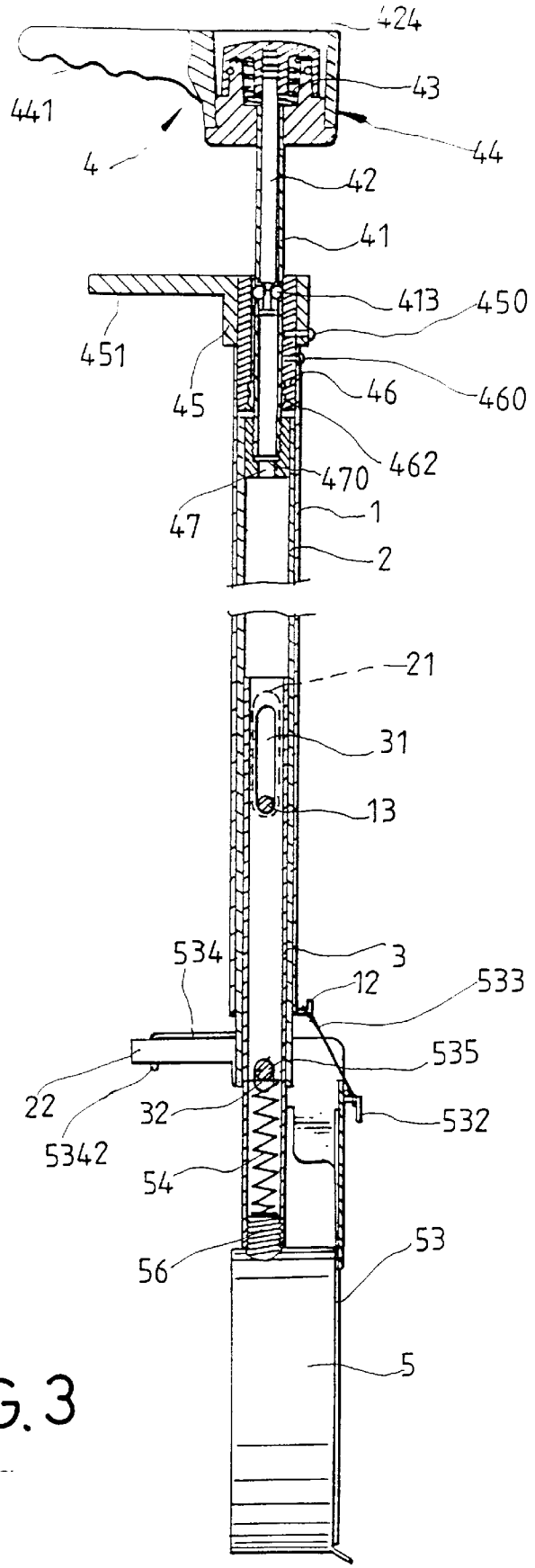
FIG. 3 is a vertical sectional view of the refuse collection device in a closed condition with the collection bag removed.

With reference to the drawings and in particular to FIGS. 1–3, wherein a refuse collection device constructed in accordance with the present invention is shown, the refuse collection device of the present invention comprises an elongated rod or tubular portion which in general use is substantially upright with an axis thereof extending substantially vertically, having a lower end to which a flexible refuse collection container 6 is mounted and openably closed by means of a cover 53 and an upper end to which a control 4 is mounted to open the cover 53 for collecting refuse (not shown) into the collection container 6. The control 4 is designed to be handled and operable with one single hand of a user.

The elongated rod portion of the refuse collection device comprises an outer tube 1, an intermediate tube 2 and an inner tube 3 telescoping each other with the inner tube 3 received inside the intermediate tube 2 and the outer tube 1 fit over the intermediate tube 2, as shown in FIG. 3. Each of the tubes 1, 2 and 3 has an upper end and an opposite lower end. The control 4 is mounted to the upper end of the intermediate tube 2. The lower end of the inner tube 3 extends outside the intermediate tube 2 with a bag mount 5 fixed thereto for supporting the collection container 6.

As shown in FIGS. 2 and 3, the bag mount 5 comprises a semi-circular frame having a lower flat section adapted to be positioned against the ground and an arc upper section connected to the flat section to define therebetween a refuse passage. Preferably, the lower section of the mount 5 comprises a downward inclined edge 52 for facilitating moving the refuse into the container 6. The upper section of the bag mount 5 has an opening 51, preferably substantially centered on the upper section. The bag mount 5 is fixed to the lower end of the inner tube 3 by any known means, such as welding, in such a manner that the opening 51 of the bag mount 5 is aligned with the lower end of the inner tube 3. The lower end of the inner tube 3 is provided with inner threading 33 that is accessible through the opening 51 of the bag mount 5.

Figure 4:
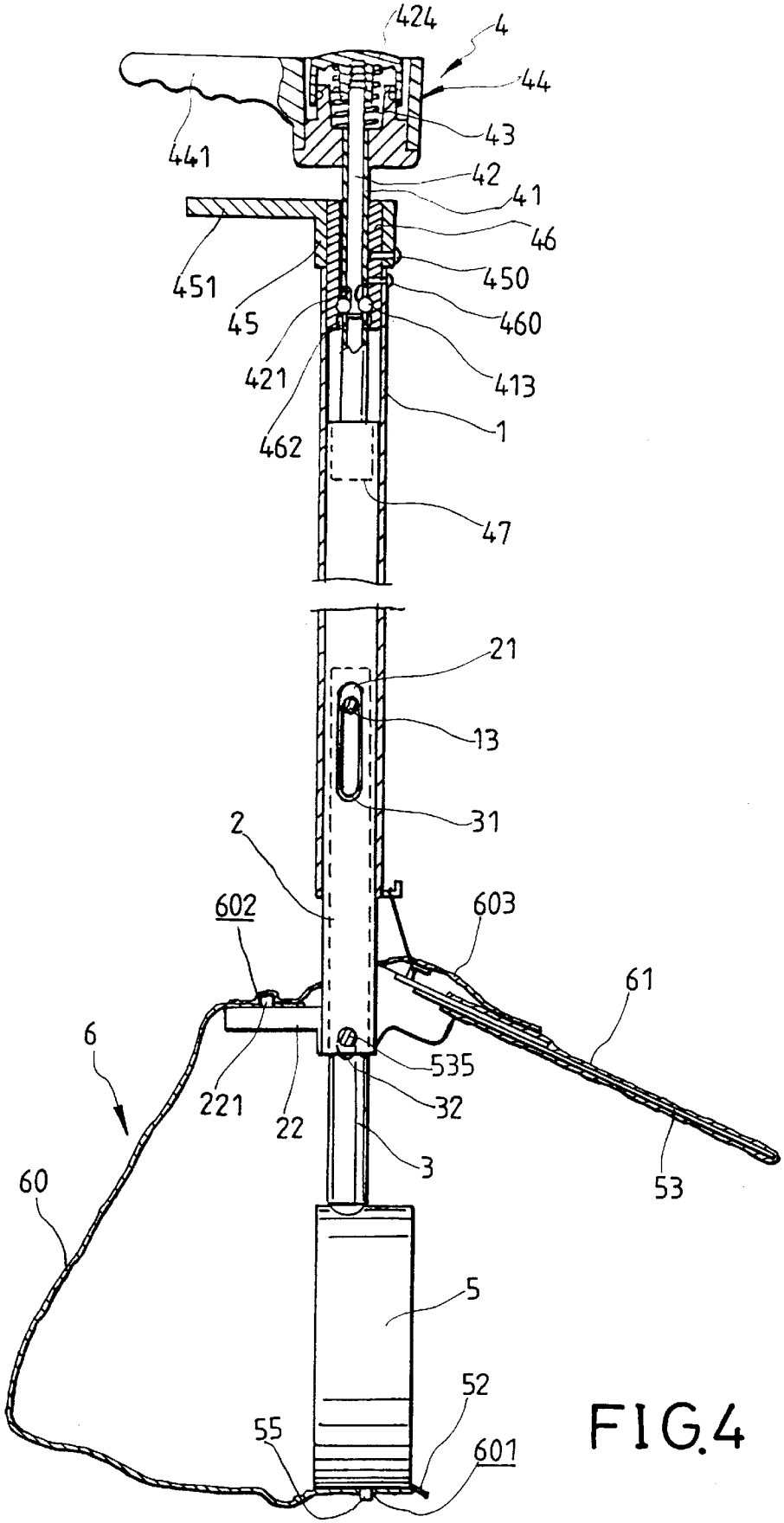
FIG. 4 is a side elevational view, partially sectioned, of the refuse collection device of the present invention in an open condition.

An externally-threaded plug 56 is provided to threadingly engage the inner threading 33 of the inner tube 3 through the opening 51 of the bag mount 5 to support and retain a helical spring 54 within the lower end of the inner tube 3. The inner tube 3 is provided with a first pair of slots 32 which are elongated in the axial direction and diametrically aligned with each other to movably receive therein a pivot pin 535 extending through both slots 32. The elongated slots 32 of the inner tube 3 has a predetermined axial length which will be further described. The slots 32 are axially spaced from the lower end of the inner tube 3 to define a distance from the plug 56 for accommodating therein the spring 54. The spring 54 is in general compressed to bias the inner tube 3 relative to the pivot pin 535 so as to locate the pivot pin 53 at an axial upper end of the elongated slots 32 of the inner tube 3, as shown in FIGS. 3 and 4.

The intermediate tube 2 is provided at a lower portion thereof exposed outside the outer tube 1 with two diametrically opposite holes 23 corresponding to the slots 32 of the inner tube 3 to allow the pivot pin 535 to extend therethrough to serve as a pivot for the cover 53.

The cover 53 comprises a semi-circular plate, substantially corresponding to the semi-circular frame of the bag mount 5 with an extension substantially parallel with the elongated rod portion in the axial direction of the rod assembly. The plate has two lugs 530 extending therefrom and spaced from each other in such a way to receive the elongated rod portion, particularly the lower end of the intermediate tube 2, therebetween. Each of the lugs 530 is provided with a hole 531 aligned with each other and corresponding to the holes 23 of the intermediate tube 2 to receive the pivot pin 535 therethrough. This allows the cover 53 to be rotatable about the pivot pin 535 and thus making the semi-circular plate portion of the cover 53 movable relative to the bag mount 5 between open position and closed position for opening/closing the refuse passage defined between the upper section and lower section of the bag mount 5.

Biasing means 534 is provided between the rod portion and the cover 53 to bias the cover 53 to close the refuse passage defined by the bag mount 5. With the biasing means 534, the refuse passage defined by the bag mount 5 is a normally-closed design. Namely, it is normally closed by the cover 53 under the biasing force of the biasing means 534 and will only be opened by manually actuating the control means 4 to move the cover 53 against the biasing means 534. This prevents the refuse collected in the collection container 6 that is mounted to the bag mount 5 from accidentally moving out of the collection container 6 to cause a second contamination. The actuation of the control means 4 for opening the cover 6 will be further discussed hereinafter.

In the embodiment illustrated, the biasing means 534 comprises a torsional spring, having a U-shaped configuration fit outside the two spaced lugs 530 of the cover 5. The U shape has two side limbs, each having a plurality of turns of the torsional spring formed thereon to define a bore 5341 loosely fit over the pivot pin 535 to be held thereon. The limbs of the U shape also have a bent end 5342 to be received and held within corresponding apertures 222 formed on a sideways tab 22 fixed to the intermediate tube 2.

A connecting link 533 is provided to connect between the cover 53 and the outer tube 1, see FIG. 3. This is accomplished by providing hook-like members 12 and 532 on both the outer tube 1 and the cover 53 and forming hangers on both ends of the connecting link 533 to engage the hook-like members on the outer tube 1 and the cover 53.

The control means 4 comprises a cylinder 47 which is sized to be received and fixed within an upper end of the intermediate tube 2 by any suitable means, such as press fitting or welding or simply a pin 470 (see FIG. 2) extending through both the intermediate tube 2 and the cylinder 47. The cylinder 47 comprises a central bore which is provided with inner threading 471. The threading 471 is formed so as not to interfere with the pin 470 that secures the cylinder 47 to the intermediate tube 2.

The intermediate tube 2 is arranged inside the outer tube 1 so that the upper end of the intermediate tube 2 is completely located within the outer tube 1. A cylindrical sleeve 46 having an outer diameter substantially corresponding to that of the intermediate tube 2 is fit into the upper end of the outer tube 1 with a portion thereof located outside the outer tube 1 and secured to the outer tube 1 by means of, for example, a rivet 460 so as to serve as an axial extension of the outer tube 1. The sleeve 46 has a central bore defining a substantially smooth inner cylindrical surface, into which a hollow shaft 41 is movably fit. The hollow shaft 41 has threading 410 or 411 provided at each one of upper and lower ends thereof. The shaft 41 extends through the central bore of the sleeve 46 to have the lower end threading 411 thereof threadingly engage the inner threading 471 of the cylinder 47 for securing the shaft 41 to the cylinder 47 and thus serving as an axial extension of the intermediate tube 2.

The hollow shaft 41 is provided with a plurality of openings 412 around a circumference thereof at a suitable position between the upper and lower threaded ends 410 and 411 to each receive therein a spherical member 413. The openings 412 are sized to allow the spherical members 413 to freely move therethrough.

Figure 7:
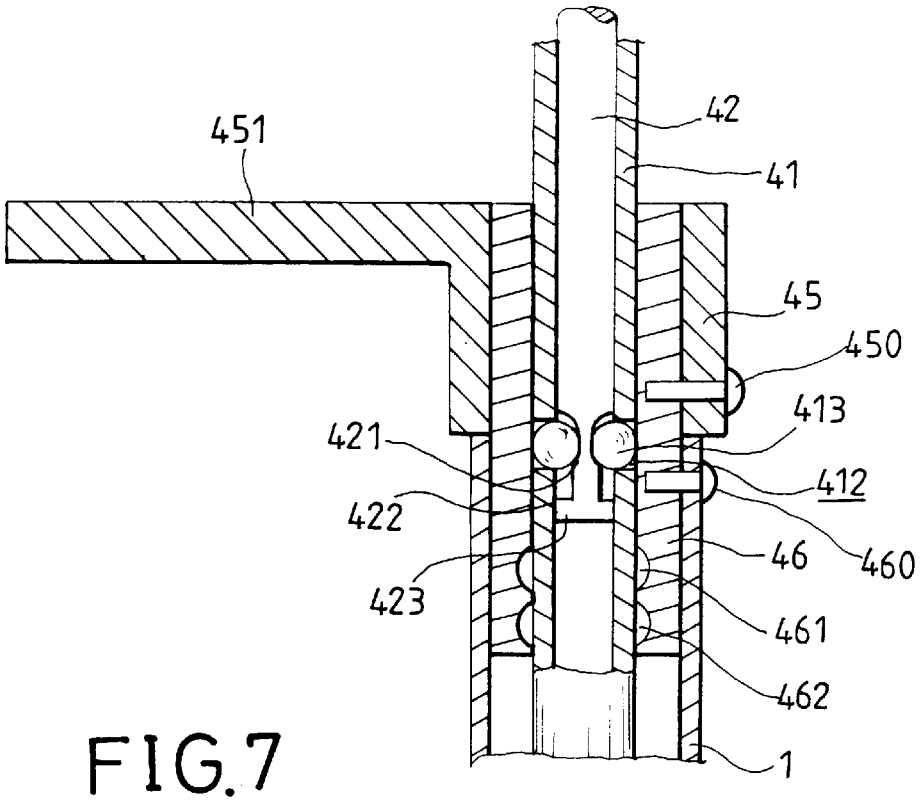
FIGS. 7 and 8 are partial cross-sectional views showing the operation of the control device incorporated in the refuse collection device of the present invention.
Figure 8:
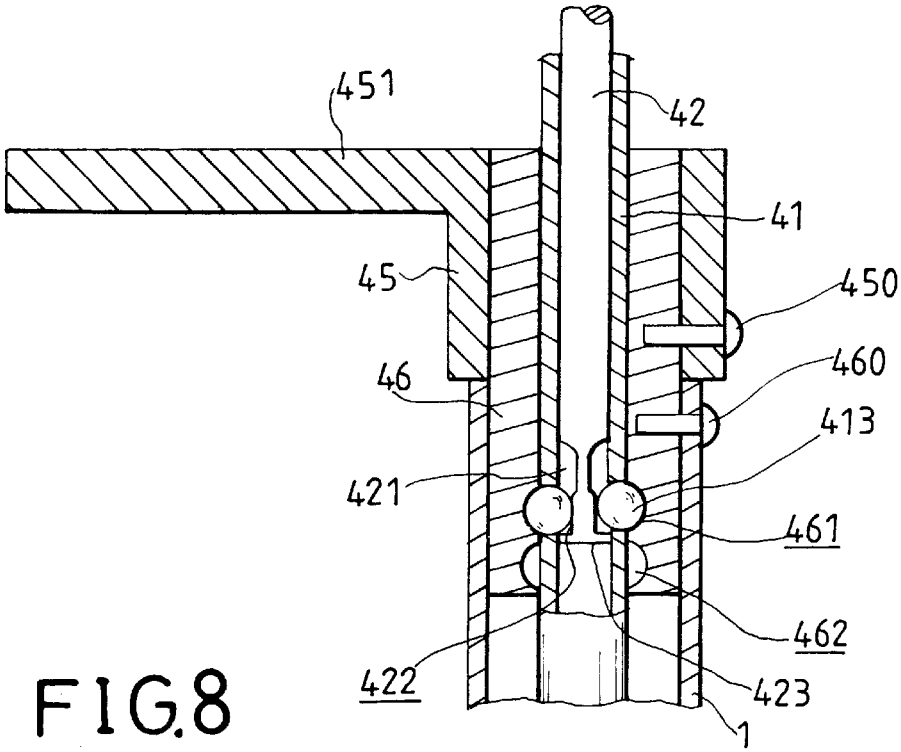

The control means 4 further comprises a shank 42 which has an outer diameter or cross-sectional dimension corresponding to the inner diameter of the hollow shaft 41 so as to be axially movably received within the hollow shaft 41. The shank 42 has a step-like groove formed on a lower end thereof to correspond to each of the openings 412 of the hollow shaft 41. The step-like grooves comprise a first recess 421 having a first depth measured from the outer surface of the shank 42 and a second recess 422 juxtaposing the first recess 421 and having a second depth smaller than the first depth. An inclined transition diverging from the first depth of the first recess 412 toward the second depth of the second recess 422 is formed between the two recesses 412 and 422. A flange 423 is formed next to the second recess 422 to define, together with the second depth, a shoulder on the shank 42. In accordance with the present invention, the first depth of the first recess 421 is such as to allow the respective spherical member 413 to be completely located inside the hollow shaft 41 (see FIG. 7), while the second depth of the second recess 422 that is smaller than the first depth does not allow the spherical member 413 to be completely received within the hollow shaft 41 and forces the spherical member 413 to partially protrude out of the hollow shaft 41 through the respective openings 412. The second depth is also such that the respective spherical member 413 that is partially received within the second depth of the second recess 422 acts against the shoulder defined by the second depth and the flange 423 to serve as a stop that prevents the shank 42 from further moving relative to the hollow shaft 41, as shown in FIG. 8.

To accommodate the protrusion of the spherical members 413, the sleeve 46 is provided on the inner surface thereof with two inner grooves 461 and 462, respectively, corresponding to different relative positions of the shaft 41 with respect to the sleeve 46. The grooves 461 and 462 are preferably circumferential around the inner surface of the sleeve 46. This will be further discussed hereinafter. The grooves 461 and 462 are sized to receive the protrusion of the spherical members 413 therein when the spherical members 413 are located within the second recesses 422 of the shaft 41, see FIG. 8. Particularly, the grooves 461 and 462 have a semi-circular or arc cross section which snugly accommodates the protrusion of the spherical members 413 therein when the spherical members 413 are driven to partially protrude out of the hollow shaft 41 by the second recesses 422 of the shank 42, as shown in FIG. 8. The semi-circular or arc cross section of the grooves 461 and 462 may also serve as camming means for driving the spherical members 413 back into the first recesses 421.

The accommodation of the protrusion of the spherical members 413 in either one of the grooves 461 and 462 prevents the shaft 41 from moving relative to the sleeve 46 that is secured to the outer tuber 1 by means of the rivet 460. This, together with the stop function provided by the action of the spherical members 413 against the flange 423, the shank 42, the hollow shaft 41 and the sleeve 46 which is secured to the outer tube 1 by means of the rivet 460 may be secured together against movement relative to each other.

The control means 4 further comprises a fixed grip 44 and a movable grip 45. The movable grip 45 comprises a cylindrical body having a finger holding extension 451 to be held by the fingers of one hand of a user. The cylindrical body of the movable grip 45 is fit over the portion of the cylindrical sleeve 46 that is located outside the outer tube 1. The cylindrical body of the movable grip 45 is dimensioned so that a lower end of the cylindrical body of the movable grip 45 is resting on the upper end of the outer tube 1 and an upper end of the cylindrical body of the movable grip 45 is substantially flush with the upper end of the sleeve 46. The movable grip 45 is secured to the sleeve 46 by means of, for example, a rivet 450.

The fixed grip 44 comprises a cylindrical body with a palm holding extension 441 extending therefrom. The cylindrical body of the fixed grip 44 has a central bore 442 with a reduced, inner-threaded section to threadingly engage and thus secure to the upper threading 410 of the shaft 41. The shank 42 that is movably received within the shaft 41 has an upper end extending out of the upper end of the shaft 41 for securing and supporting thereon a manual button 424 which is movably received within the central bore 442 of the fixed grip 44 with a compression spring 43 located therebetween. The compression spring 43 forces the button 424 and the shank 42 secured thereto to move upwards (in a regular upright operation status) relative to and away from the hollow shaft 41 and the fixed grip 44 secured to the shaft 41.

The outer tube 1, the intermediate tube 2 and the inner tube 3 are respectively provided with diametrically opposite holes 11, elongated slots 21 and elongated slots 31 which are substantially corresponding to each other to receive a pin 13 extending therethrough. The pin 13 is fixed in the holes 11 of the outer tube 1 to be axially movable in unison therewith. The elongated slots 21 and 31 of the intermediate tube 2 and inner tuber 3 allow the pin 13 to move therein and relative thereto which in turn allows the outer tube 1 to be axially movable relative to the intermediate tube 2 and inner tube 3. The elongated slot 31 of the inner tube 3 has an axal length shorter than the elongated slot 21 of the intermediate tube 2 and the axial length difference is substantially equal to the axial length of the slots 32 that receives the pivot pin 535 therein so as to allow the inner tube 3 to axially move relative to both the intermediate tube 2 and the pivot pin 535 that is axially fixed to the intermediate tube 2 a distance substantially identical to the axial length of the slots 32. This is more clear by considering the situation shown in FIG. 4 by regarding the intermediate tube 2 and the pivot pin 535 as stationary, then the elongated slots 32 allow the inner tube 3 to move upward and similarly the length difference between the slots 31 and 21 also allows the inner tube 3 to move upward relative to the intermediate tube 2. The purpose to allow the inner tube 3 to move relative to the intermediate tube 2 will be described hereinafter.

Figure 6:
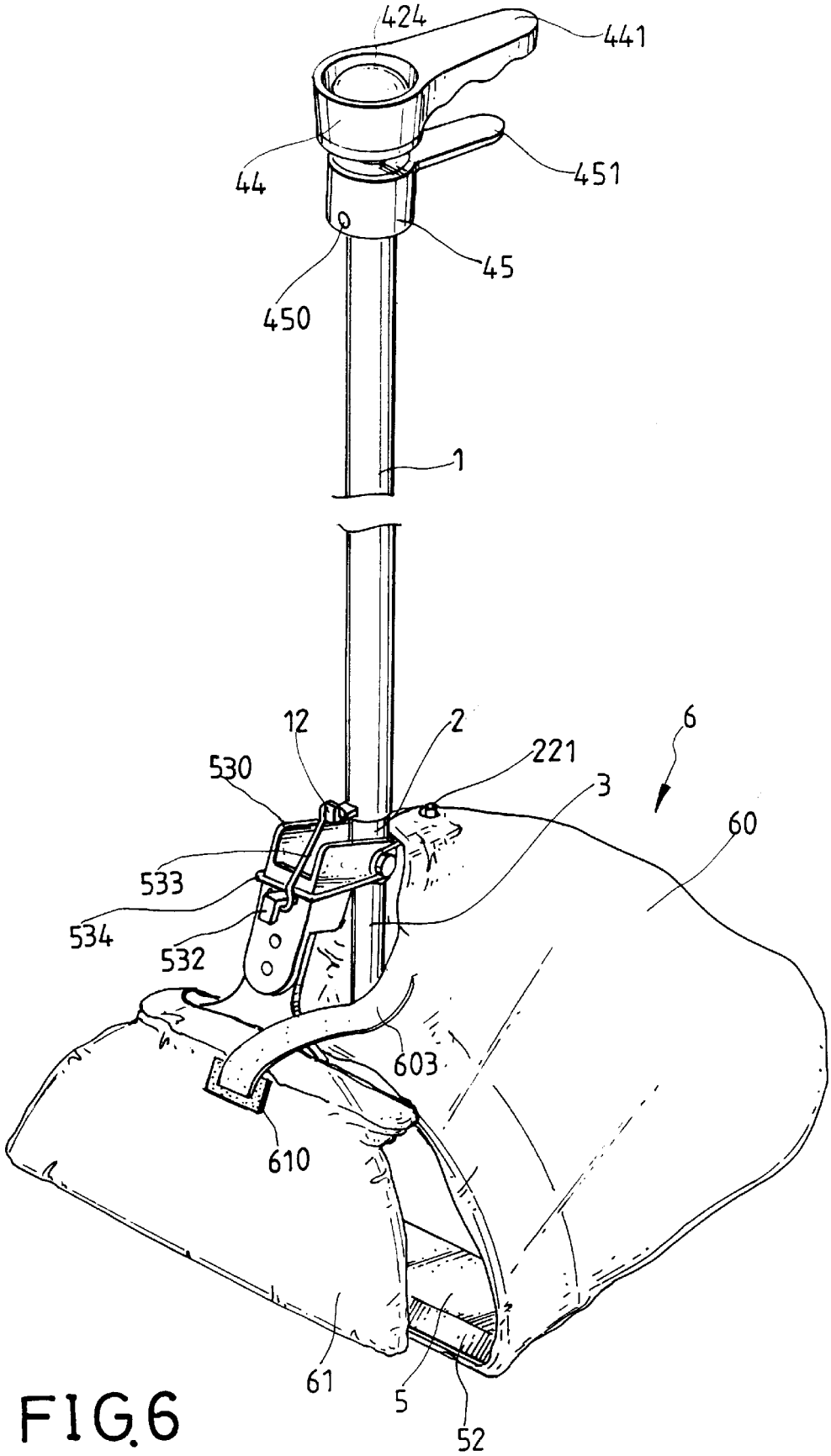
FIG. 6 is a perspective view of the refuse collection device of the present invention in an open condition.

Referring to FIGS. 1, 4 and 6, the collection container 6 comprises a primary bag 60 which has an opening having a plurality of apertures 601 spaced along a section of the opening to be loosely fit over corresponding pegs 55 provided on underside of the lower section of the bag mount 5. The primary bag 60 also comprises a further aperture 602 loosely fit over an upper peg 221 provided on the sideways tab 22 of the intermediate tube 2. The movability of the inner tube 3 to which the bag mount 5 is secured relative to the intermediate tube 2 allows the primary bag 60 to be expanded and thus securely held on the bag mount 5.

The collection container 6 also comprises a secondary bag 61 which is configured to substantially fit over the cover 53 for preventing the cover 53 from being contaminated by the refuse collected by the refuse collection device of the present invention. The primary bag 60 has an extension strip 603 which extends over the secondary bag 61 to attach to the secondary bag 61 by means of, for example, adhesive pad or material 610 so as to secure the secondary bag 61 to the primary bag 60 and securely hold both the primary bag 60 and the secondary bag 61 on the bag mount 5 and the cover 53.

To collect refuse, one may position the refuse collection device of the present invention next to the refuse at a suitable distance to allow the cover 53 to open with the refuse passage defined by the bag mount 5 facing the refuse. To open the cover 53, one may use the palm of one's hand to hold the palm holding extension 441 of the fixed grip 44 with the fingers holding the finger holding extension 451 of the movable grip 45. By contracting the hand, the movable grip 45 is driven by the fingers toward the fixed grip 44. Due to the fact the movable grip 45, the sleeve 46 and the outer tube 1 are secured together by means of the rivets 450 and 460, and further due to the fact that the intermediate tube 2 is fixed to the hollow shaft 41 by means of the cylinder 47 and the hollow shaft 41 is threadingly secured to the fixed grip 44, the movement of the movable grip 45 causes the outer tube 1 (as well as the sleeve 46) to move axially upward relative to the intermediate tube 2 (as well as the hollow shaft 41). In the closed condition before the user moves the movable grip 45, the spherical members 413 are constrained within the openings 412 of the shaft 41 by the cylindrical inner surface of the sleeve 46 and located on and supported by the inclined transition between the first recesses 421 and the second recesses 422 of the shank 42 so that the movement of the outer tube 1 relative to the intermediate tube 2 is substantially not interfered with by the spherical members 413 at all, as shown in FIGS. 3 and 7. The relative movement between the outer tube 1 and the intermediate tube 2 allows the link 533 to pull the cover 53 upward relative to the bag mount 5 by rotating about the pivot pin 535 against the torsional spring 534. This opens the cover 53.

Also, the relative movement between the movable grip 45 that is fixed to the sleeve 46 and the fixed grip 44 that is threadingly secured to the hollow shaft 41 drives the sleeve 46 upward relative to the hollow shaft 41 to such a position where the first groove 461 of the sleeve 46 is substantially aligned with the openings 412 of the hollow shaft 41 to allow the spherical members 413 to be driven radially outward by means of the contact and camming engagement thereof with the inclined transitions between the first recesses 421 and the second recesses 422 of the shank 42. The camming action is provided by means of the compression spring 43 between the button 424 to which the shank 42 is fixed and the fixed grip 44. The outward projection of the spherical members 413 makes the spherical members 413 to be partially received within the first groove 461 of the sleeve 46 and partially located in the second recesses 422 of the shank 42, as shown in FIG. 4. Also, the spherical members 413 are in contact engagement with the flange 423 next to the second recesses 422 of the shank 42 at this moment. This fixes the outer tube 1 with respect to the intermediate tube 2 via the engagement among the spherical members 413, the sleeve 46 and the hollow shaft 41 so that the cover 53 is fixed at the open position as shown in FIG. 4.

By positioning the opened refuse collection device very close to the refuse to be collected, the user may now release the outer tube 1 by depressing the button 424 against the compression spring 43. This moves the shank 42 relative to the spherical members 413 within the openings 412 of the hollow shaft 41 to such a position where the first recesses 421 of the shank 41 are substantially aligned with the openings 412. Due to the camming function provided by the semi-circular cross section of the first groove 461, the spherical members 413 are forced inward by means of the spring force of the torsional spring 534 acting upon and pulling the outer tube 1 downward via the link 533. The spherical members 413 are forced into the openings 412 of the hollow tube 41 with a portion thereof received in the first recesses 421 and the outer tube 1 is allowed to moved downward by being acted upon by the spring force of the torsional spring 534 and the own weight thereof. Such a downward movement of the outer tube 1 and the torsional spring 534 accelerates the rotation of the cover 53 toward the closed position as shown in FIG. 3. Thus, when the cover 53 hits the refuse, the covers strikes and scoops the refuse into the primary bag 60 via the refuse passage defined by the bag mount 5.

The slots 31 and 21 of the inner tube 3 and intermediate tube 2 are dimensioned and positioned such that the movement of the outer tube 1 from the closed position in FIG. 3 to the open position in FIG. 4 is not interfered with by the slots 21 and 31 and when the outer tube 1 is at the closed position, the pin 13 that is carried by the outer tube 1 is substantially coincident with the upper end of the slots 31 of the inner tube 3, see FIG. 4.

Figure 5:
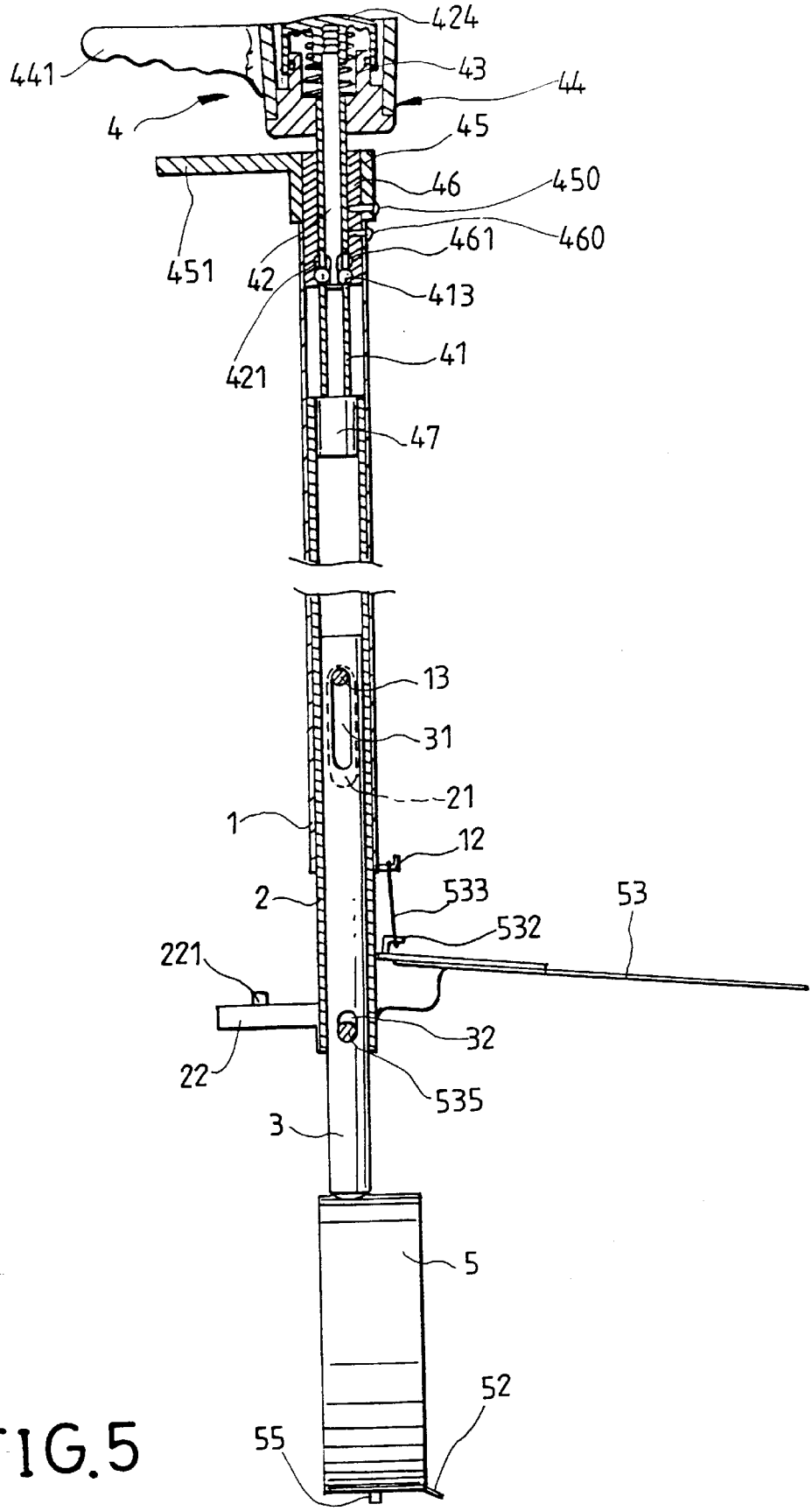
FIG. 5 is a vertical sectional view of the refuse collection device in an open condition with the collection bag removed.

To dispose the collected refuse, in accordance with the present invention, the refuse collection container 6 may be detached from the bag mount 5 without the user's hand directly touching the collection container 6. This is done by horizontally holding the refuse collection device with the cover 53 facing upward and pulling the movable grip 45 toward the fixed grip 44. The operation brings the first groove 461 of the sleeve 46 to the position where it aligns with the openings 412 of the hollow tube 41 so that the spherical members 413 enter and engage the first groove 461 and this is identical to the operation of opening the cover 53. Thereafter, by depressing the button 424 to allow the spherical members 413 to move back into the openings 412 by being acted upon by the inward camming force provided by the semi-circular cross section of the first groove 461, the spherical members 413 are disengaged from the first groove 461 and the movable grip 45 is again free to move relative to and further toward the fixed grip 44. By depressing the button 424 and simultaneously moving the grip 45 to release the engagement of the spherical members 413 and the first groove 461 and then immediately releasing the button 424, the spherical members 413 will immediately resume being biased by the camming engagement thereof with the inclined transitions between the first recesses 421 and the second recesses 422 of the shank 42 toward contact engagement with and constrained by the inner surface of the sleeve 46. By further moving the movable grip 45 toward the fixed grip 44, the second groove 462 reaches the position where the openings 412 of the hollow tube 41 are aligned with the second groove 462 which is located lower than the first groove 461 when viewed in the regular upright condition to allow the spherical members 413 to engage the second groove 462 by being acted upon by the inclined transition between the first and second recesses 421 and 422 and thus fix the movable grip 45 relative to the fixed grip 44, as shown in FIG. 5. Since the second groove 462 is located lower than the first groove 461, in other words, the distance between the second groove 462 and the openings 412 of the hollow tube 41 in the closed condition in FIG. 3 is greater than that between the first groove 461 and the openings 413, the movable grip 45 under this condition is moved further toward the fixed grip 44 and the cover 53 is opened wider, as shown in FIG. 5 which also helps facilitating detachment of the collection container 6 from the mount 5.

Quite obviously, the movement of the sleeve 46 to have the first groove 461 engaged by the spherical members 413 that are held within the openings 412 of the hollow tube 41 may be un-limitedly repeated for arbitrarily opening the cover 53 to perform a number of times of scooping refuse into the container 6 and also in the final, detachment operation of the refuse collection container from the mount 5. The present invention provides a simple and ready-to-operate mechanism for to repeatedly open and close the cover in collecting refuse which also provides a similar operation in disposing the refuse so collected by detaching the collection container from the mount 5.

Since in the open position, the pin 13 is substantially coincident with and engages the upper end of the slots 31 of the inner tube 3, the addition movement of the outer tube 1 from the first groove 461 to the second groove 462 causes the pin 13 to drive the inner tube 3 to move with the outer tube 1 by means of the engagement between the pin 13 and the slots 31. The intermediate tube 2 that is secured to the fixed grip 44 via the hollow shaft 41, however, remains stationary and not influenced due to the length of the slots 32 that allows the inner tube 3 to move relative to the pivot pin 535 that is fixed on the intermediate tube 2.

Due to the relative movement between the inner tube 3 and the intermediate tube 2, the spring 54 is compressed and the distance between the upper peg 221 on the intermediate tube 2 and the lower section of the bag mount 5 (or more precisely the lower pegs 55) is reduced. This loosens the primary bag 60 from the pegs 55 and upper peg 221. The user may simply shake the refuse collection device to detach the primary bag 60 from the bag mount 5. Thereafter, by rotating the refuse collection device to have the cover 53 facing downward, the weight of the refuse collected and the primary bag 60 drives the secondary bag 61 off the cover 53 with the connection therebetween provided by the extension strip 603 of the primary bag 60. Thus, the refuse collected in the primary bag 60 and the collection container 6 are both disposed into any suitable processing device or facility without the user's hand directly touching the probably contaminated collection container 6.

Although the invention has been described in connection with the preferred embodiment of the present invention, it is apparent to those skilled in the art that many changes, variation and modifications are possible without departing from the scope of the invention as defined in the appended claims.

What is claimed is:

1. A refuse collection device comprising:

an outer tube having an upper end and a lower end in an axial direction, the outer tube having an inner cross-sectional dimension;

an inner tubular assembly having an upper and a lower end, the inner tube being received within the inner cross-sectional dimension of the outer tube to have the upper end thereof located within the outer tube and the lower end thereof extending out of the lower end of the outer tube, the outer tube being axially movable relative to the inner tubular assembly between an axial upper position and a lower position;

a collection container assembly, comprising a mount fixed to the lower end of the inner tubular assembly and defining a refuse passage, a cover substantially corresponding in shape to the refuse passage and rotatably connected to the inner tubular assembly by means of a pivot pin supported on the inner tubular assembly to be movable between a closed position where the cover substantially seals the refuse passage and an open position where the cover is angularly displaced from the closed position at a first angle to open the refuse passage, the cover being drivingly coupled to the outer tube to be driven thereby to rotate between the closed position and the open position when the outer tube is moved relative to the inner tubular assembly between the lower position and the upper position, the collection container further comprising a primary bag having an opening fixed to the mount and surrounding the refuse passage defined by the mount; and control means comprising:

a first grip fixed to the upper end of the outer tube and having a central bore co-axially aligned with and in communication with the inner cross-sectional dimension of the outer tube, the central bore defining a smooth inner surface, a second grip having a shaft extending therefrom to be axially fixed to the inner tubular assembly, the shaft being slidably received within the bore of the first grip to allow the first grip to be movable relative to the second grip in unison with the outer tube between the upper position and the lower position, locking means comprising a first groove formed on the inner surface of the central bore of the first grip and at least a radial opening formed on a circumference of the hollow shaft to movably receive therein a spherical member, the radial opening being located on the hollow shaft to completely receive the spherical member therein by being acted upon by the smooth inner surface of the central bore of the first grip when the outer tube is in the lower position where the cover is in the closed position, a first biasing element being provided to bias the spherical member out of the radial opening and partially into and thus engaging the first groove of the first grip when the outer tube is in the upper position to securely hold the outer tube in the upper position and the cover in the open position by means of the engagement between the spherical member and the first groove of the first grip, and releasing means for breaking the engagement between the spherical member and the first groove of the first grip by allowing the spherical member to be moved back into the radial opening so as to allow the outer tube to move from the upper position to the lower position and thus closing the cover.

2. The refuse collection device as claimed in claim 1, wherein the cover comprises a second biasing element biasing the cover toward the closed position so that when the outer tube is released from the upper position, the cover is forced back to the closed position by means of the second biasing element.

3. The refuse collection device as claimed in claim 1, wherein the shaft comprising a hollow member having a bore with the radial opening formed on the hollow member to allow the spherical member to be partially located within the bore of the hollow shaft and wherein the locking means comprises a shank movably received within the hollow shaft, the shank comprising at least one first recess having a first depth and a corresponding second recess having a second depth smaller than the first depth formed thereon and juxtaposing each other and connected by means of an inclined transition which diverges from the first depth to the second depth to define a camming surface, the first depth corresponding to the radial opening and such as to allow the spherical member to be completely received within the radial opening of the hollow shaft and the second depth being such as to partially project the spherical member out of the radial opening, the first biasing element being provided between the shank and the hollow shaft to bias the shank in such a way to have the spherical member located in the second recess so that when the outer tube is in the lower position, the spherical member is acted upon by the smooth inner surface of the first grip to be completely received within the radial opening so as not to interfere with the relative movement between the shank and the hollow shaft and when the outer tube is in the upper position, the shank is biased by the first biasing element to have the camming surface acting upon the spherical member for protruding the spherical member out of the radial opening and partially into the first groove of the first grip so as to securely fix the first grip in the upper position.

4. The refuse collection device as claimed in claim 3, wherein the releasing means comprises a manual button which is received within a bore that is formed on the second grip and in communication with the bore of the hollow shaft into which an upper end of the shank enters to be fixed to the button in a manner to be movable relative to the bore of the second grip with the first biasing element disposed between the button and the bore of the second grip so that by actuating the manual button against the first biasing element to move the shank relative to the hollow shaft for aligning the first recess with the radial opening and thus allowing the spherical member to be completely moved back into the radial opening, the engagement between the spherical member and the first grip is broken and the outer tube is released to move from the upper position toward the lower position to close the cover.

5. The refuse collection device as claimed in claim 1, wherein the coupling between the outer tube and the cover comprises a link having a hanger formed on each of two opposite ends thereof to engage hook-like members provided on both the outer tube and the cover.

6. The refuse collection device as claimed in claim 1, wherein the inner tubular assembly comprises an intermediate tube movably received within the outer tube and an inner tube movably received within the intermediate tube to be movable relative to the intermediate tube between a bag secured position and a bag released position, the intermediate tube having an upper end within the outer tube to which the shaft is secured, the inner tube having a lower end to which the mount is fixed, the refuse collection device further comprising means for securing the bag on the mount, the bag securing means comprising a plurality of lower pegs formed on a lower section of the mount to receive corresponding first apertures formed on the primary bag to loosely fit thereto and an upper peg provided on the intermediate tube to which a further aperture formed on the primary bag is loosely fit, the upper peg being spaced from the lower pegs on the lower section of the mount a predetermined distance sufficient to stretch the opening of the bag, a third biasing element being provided between the inner tube and the intermediate tube to bias the inner tube relative to the intermediate tube toward the bag secured position and maintain the predetermined distance between the lower and upper pegs so as to stretch the primary bag for securing the bag to the mount.

7. The refuse collection device as claimed in claim 6, further comprising bag disposing means comprising driving means to move the inner tube relative to the intermediate tube against the third biasing element from the bag secured position toward the bag releasing position to reduce the distance between the upper and lower pegs and thus releasing the bag from the pegs.

8. The refuse collection device as claimed in claim 6, further comprising secondary locking means for securing the inner tube in the bag releasing position.

9. The refuse collection device as claimed in claim 8, wherein the secondary locking means comprises a second groove formed on the inner surface of the central bore of the first grip to be engageable by the spherical member and a coupling between the outer tube and the inner tube which allows the inner tube to be movable with the outer tube when the outer tube is moved to have the spherical member engaging the second groove and thus move the inner tube to the bag releasing position.

10. The refuse collection device as claimed in claim 9, wherein the coupling between the outer tube and the inner tube comprises a pin carried by and transversely extending through the outer tube, the intermediate tube having a first pair opposite elongated slots and the inner tuber having a second pair of opposite elongated slots through which two opposite ends of the pin extend, the first pair of slots having a first axial length and the second pair of slots having a second axial length which is shorter than the first axial length, the second axial length being such as to allow the outer tube to move from the lower position to the upper position without any interference between the pin and the second slots, and the second groove being positioned inside the first grip so as to be further than the first groove for the outer tube moving from the lower position to the upper position and thus a further movement of the outer tube in the direction from the lower position to the upper position driving the second groove to be engaged by the spherical member and such a further movement also causing the pin carried by the outer tube to drivingly engage and move the inner tube with the outer tube so as to move the inner tube against the third biasing element toward the bag releasing position.

* * * * *